US008727030B2

(12) United States Patent
Feenstra

(10) Patent No.: US 8,727,030 B2
(45) Date of Patent: May 20, 2014

(54) TRIM MANIFOLD ASSEMBLY FOR A SPRINKLER SYSTEM

(75) Inventor: Shawn J. Feenstra, Caledonia, MI (US)

(73) Assignee: The Viking Corporation, Hastings, MI (US)

( * ) Notice: Subject to any disclaimer, the term of this patent is extended or adjusted under 35 U.S.C. 154(b) by 695 days.

(21) Appl. No.: 13/004,971

(22) Filed: Jan. 12, 2011

(65) Prior Publication Data

US 2011/0108290 A1 May 12, 2011

Related U.S. Application Data

(63) Continuation-in-part of application No. 12/556,919, filed on Sep. 10, 2009.

(51) Int. Cl.
*A62C 37/36* (2006.01)

(52) U.S. Cl.
USPC ..... 169/19; 169/5; 169/16; 169/23; 169/56; 169/60; 137/597; 137/861

(58) Field of Classification Search
USPC ..... 169/5, 13, 16, 19, 37, 56, 60, 61; 239/71, 565; 137/597, 861
See application file for complete search history.

(56) References Cited

U.S. PATENT DOCUMENTS

| | | | | |
|---|---|---|---|---|
| 4,410,005 | A | 10/1983 | Reip | |
| 4,911,201 | A | 3/1990 | Nichols et al. | |
| 5,720,351 | A * | 2/1998 | Beukema et al. | 169/61 |
| 5,992,532 | A | 11/1999 | Ramsey et al. | |
| 6,333,689 | B1 | 12/2001 | Young | |
| 6,810,910 | B2 * | 11/2004 | McHugh | 169/61 |
| 6,848,513 | B2 | 2/2005 | Jackson et al. | |
| 7,185,711 | B2 * | 3/2007 | Jackson et al. | 169/16 |
| 2004/0011537 | A1 | 1/2004 | Jackson et al. | |
| 2007/0114046 | A1 | 5/2007 | Munroe | |
| 2007/0289751 | A1 | 12/2007 | Feenstra et al. | |

* cited by examiner

*Primary Examiner* — Steven J Ganey
(74) *Attorney, Agent, or Firm* — Harness, Dickey & Pierce, P.L.C.

(57) ABSTRACT

A trim manifold assembly includes an alarm block and a release block. The alarm block is in communication with a fire suppressant fluid supply and defines a first alarm passage in communication with an alarm sensor. The release block is coupled to the alarm block and includes a drain passage and a first control passage. The first control passage is in communication with the fire suppressant fluid supply and a pressure-actuated system control valve to control communication between the fire suppressant fluid supply and the sprinkler system.

18 Claims, 16 Drawing Sheets

TRIM MANIFOLD ASSEMBLY FOR A SPRINKLER SYSTEM

CROSS-REFERENCE TO RELATED APPLICATIONS

This application is a continuation-in-part of U.S. patent application Ser. No. 12/556,919, filed on Sep. 10, 2009. The entire disclosure of the above application is incorporated herein by reference.

FIELD

The present disclosure relates to fire protection systems and, more particularly, to a trim manifold assembly that controls the operation of the control valve of a sprinkler system for various fire protection systems.

BACKGROUND

This section provides background information related to the present disclosure which is not necessarily prior art.

Fire protection systems come in several forms. For example, deluge fire protection systems totally flood the protected area with pressurized fire suppressant, such as water by way of non-limiting example, with the system designed to empty until the control valve is closed by a release system, such as a hydraulic, pneumatic, electric, or manual release system. These deluge systems are often used in an area in which a fire may spread rapidly or in an area that contains combustible material, solutions, or the like. Other fire protection systems cycle between an actuated and non-actuated state and, in some cases, only deliver water to the effected area when activated by a heat sensor.

In some systems, the sprinkler system piping is filled with water prior to operation to permit a more rapid response. In other systems, the sprinkler piping is dry—these systems are primarily used to protect unheated structures where the system may be subject to freezing or in areas that are susceptible to water damage.

In each of these systems, the control valve that directs the flow of water to the sprinkler piping is controlled by a piping circuit or "trim piping." Trim piping varies depending on the type of system and, further, on the size of the valve. The trim piping may require over one hundred fittings that must be fastened together. The fittings can be expensive and the time to assemble the fittings adds cost to the sprinkler system. Additionally, the complexity of the trim piping may result in installation errors that can impair proper operation. Moreover, the trim piping can be cumbersome in size and weight such that use in tight spaces is inhibited and/or prohibited.

SUMMARY

This section provides a general summary of the disclosure, and is not a comprehensive disclosure of its full scope or all of its features.

A trim manifold assembly is utilized to facilitate control of the control valve in a fire protection system. The trim manifold assembly utilizes a manifold block with numerous passageways to provide desired flow communication between various components, such as automatic and manual valves, check valves, inlet and outlet ports, and sensor ports, by way of non-limiting example. The trim manifold assembly can be cost-effectively manufactured and may require less assembly steps. The trim manifold assembly can facilitate the assembly of a fire protection system and the attachment of the trim manifold assembly to the control valve for operation thereof.

According to the present disclosure, the trim manifold assembly includes an alarm block and a release block. The alarm block is in communication with a fire suppressant fluid supply and defines a first alarm passage in communication with an alarm sensor. The release block is coupled to the alarm block and includes a drain passage and a first control passage. The first control passage is in communication with the fire suppressant fluid supply and a pressure-actuated system control valve to control communication between the fire suppressant fluid supply and the sprinkler system.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
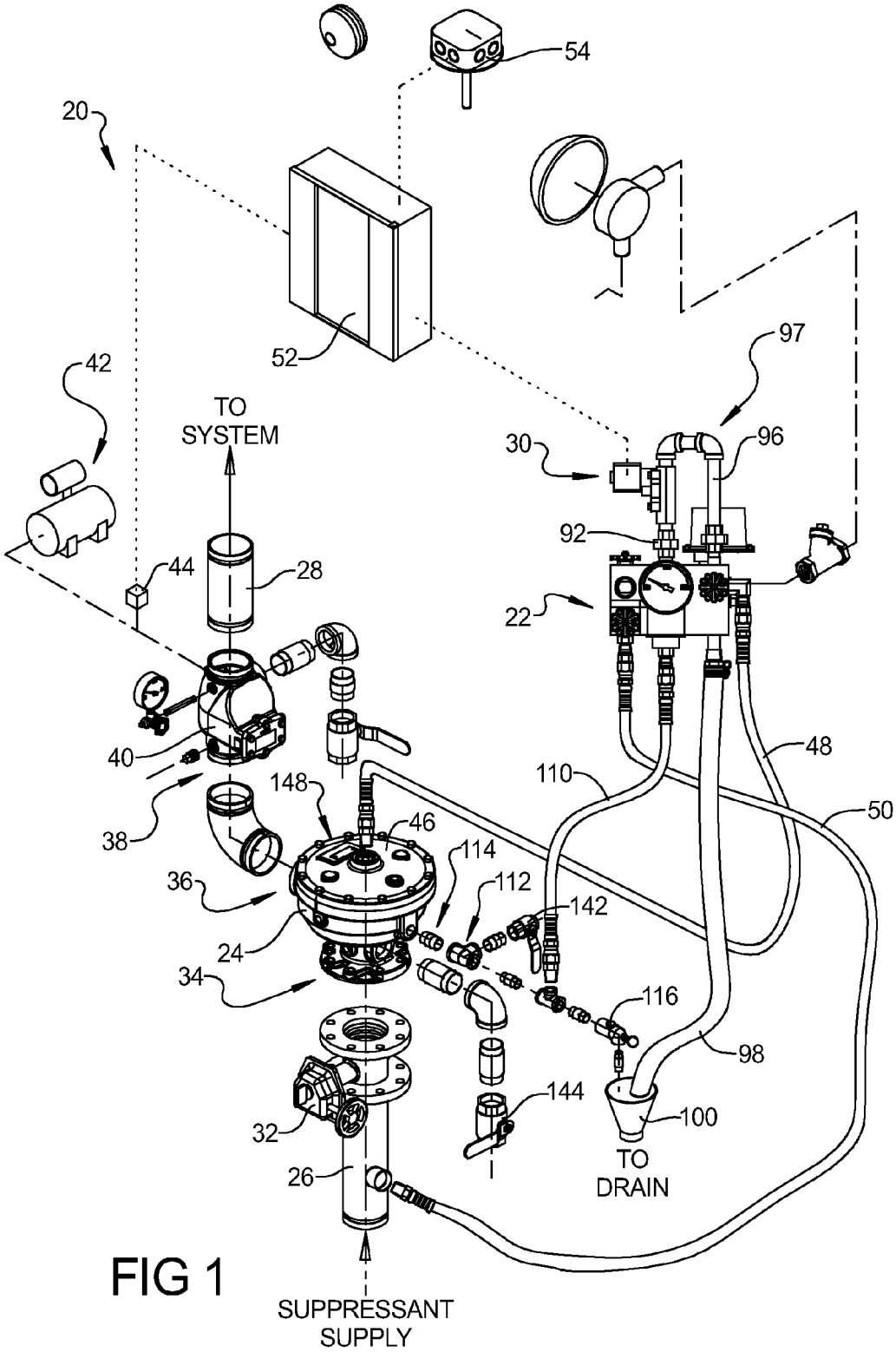
FIG. 1 is an exploded view of a portion of an exemplary pre-action deluge fire protection system utilizing the trim manifold assembly of the present invention.
Figure 2:
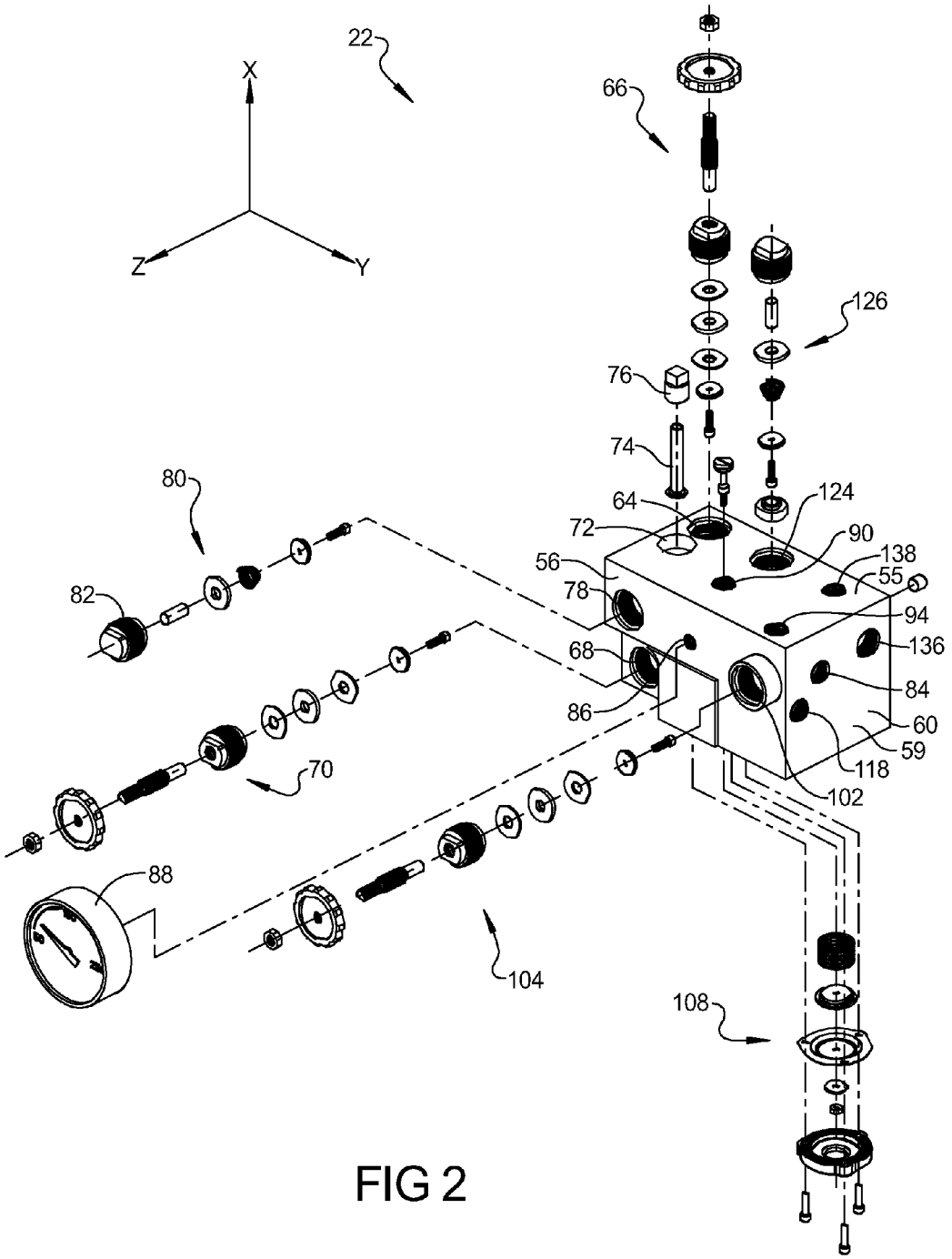
FIG. 2 is an exploded view of the trim manifold assembly of FIG. 1.
Figure 4:
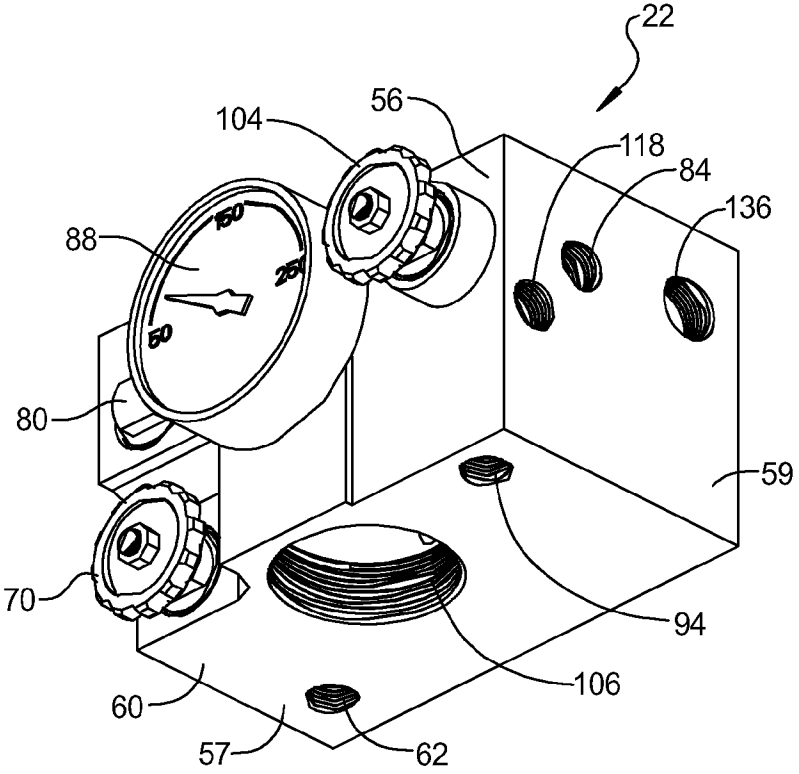
FIGS. 3 and 4 are perspective views of the trim manifold assembly of FIG. 1.
Figure 3:
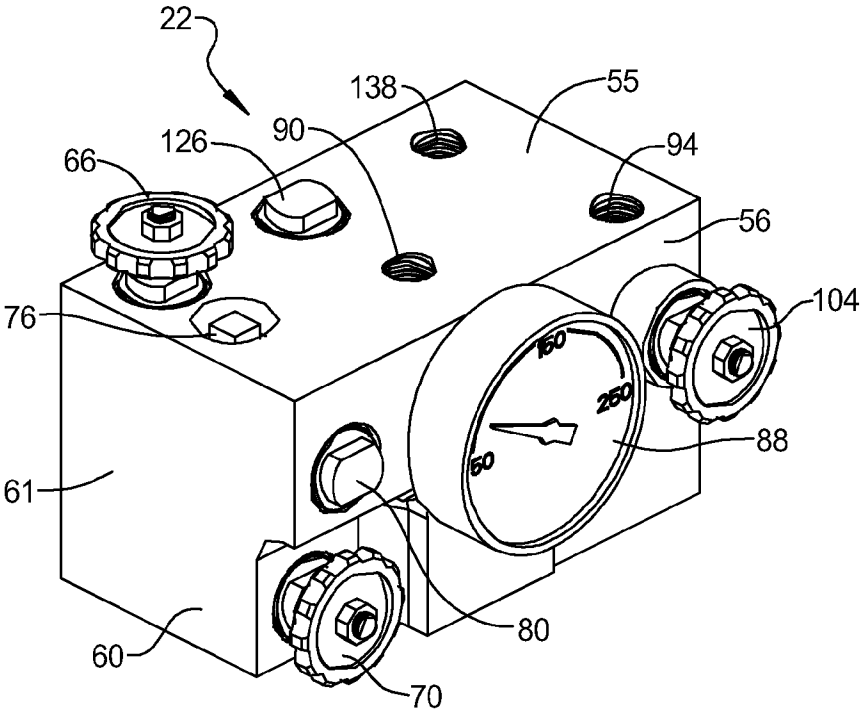
Figure 5:
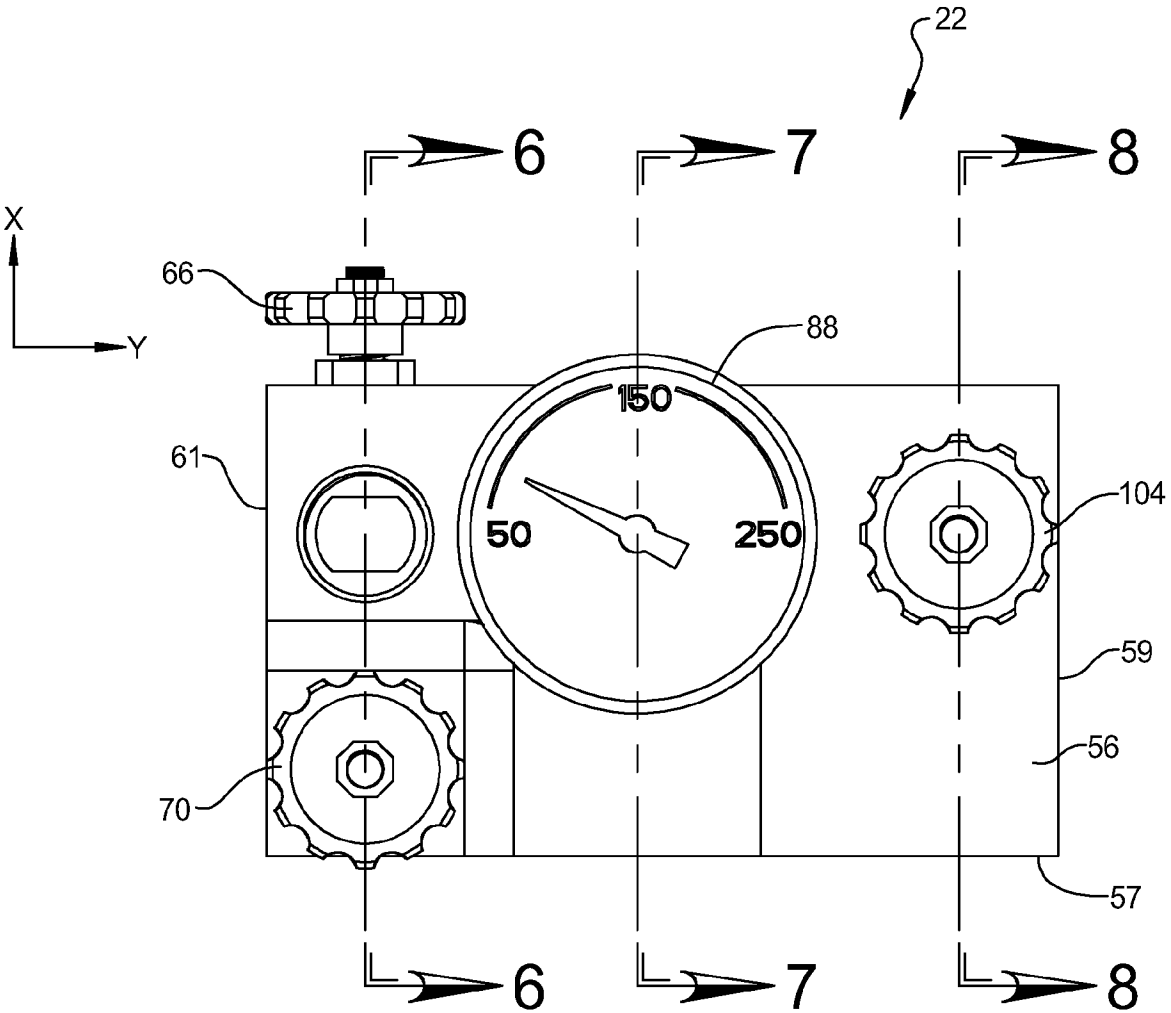
FIG. 5 is a front plan view of the trim manifold assembly of FIG. 1.

Example embodiments will now be described more fully with reference to the accompanying drawings. As used herein, the terms "top," "bottom," "right side," "left side," "front side," and "back side" refer to the orientation of the trim manifold assembly as shown in FIGS. 1-2. It should be appreciated that these terms are relative terms and that these terms are not absolute indications of the orientation of the trim manifold assembly and, rather, are merely exemplary and for purposes of description. Furthermore, it should also be understood that as used herein, the terms "normally open" and "normally closed" refer to the operational condition of the associated component when the trim manifold assembly and the fire protection system are in a ready or set condition for normal operation to activate in the event of a fire condition.

With reference to FIG. 1, a fire protection system, generally indicated at 20, incorporating a trim manifold assembly 22 of the present teachings is shown. In the illustrated embodiment, fire protection system 20 is a pre-action deluge system. It should be appreciated that a trim manifold assembly according to the present teachings may be used in other types of fire protection systems, as described below. Fire protection system 20 includes a control valve 24, which is normally closed and controls the flow of fire suppressant, such as water, from a fire suppressant supply 26 to sprinkler system piping 28, which includes a plurality of sprinklers for delivering the fire suppressant to an area protected by fire protection system 20. As will be more fully described below, trim manifold assembly 22 controls the flow of fire suppressant through valve 24 using a release mechanism 30, which is normally closed and which may be electric, pneumatic, or hydraulic, by way of non-limiting example. Furthermore, trim manifold assembly 22 may provide a compact assembly that is pre-assembled and may be pre-tested prior to installation to ease the assembly of fire protection system 20.

Fire suppressant supply 26 delivers fire suppressant to valve 24 through a supply control valve 32, which is normally open and whose output delivers fire suppressant to the input 34 of valve 24. Output 36 of valve 24 delivers fire suppressant to the input 38 of a check valve 40, whose output delivers fire suppressant to sprinkler system piping 28. Check valve 40 is provided to prevent the pressurized supervisory air in sprinkler system piping 28 from entering valve 24. Sprinkler system piping 28 is supervised with pressurized air from air system 42, which is used to monitor the pressure in fire protection system 20 to monitor the integrity of the sprinkler system piping 28 and its components. In the illustrated embodiment, air system 42 delivers pressurized air to sprinkler system piping 28 and may monitor the changes in pressure in sprinkler system piping 28 with one or more pressure switches 44.

In the illustrated embodiment, valve 24 comprises a deluge valve, which includes a priming chamber 46, as is known in the art. Trim manifold assembly 22 controls the pressure in priming chamber 46 and communicates with valve 24 and fire suppressant supply 26 through conduits 48, 50, respectively. Conduits 48, 50, by way of non-limiting example, may be flex hoses. Trim manifold assembly 22 also communicates with a control panel 52 (via wiring indicated by dotted lines in FIG. 1), which provides actuating signals to or monitors signals from components within trim manifold assembly 22 and also components located exteriorly of trim manifold assembly 22 to control the opening of valve 24 in response to low-pressure signals from pressure switch 44 and in response to fire-condition signals from detector 54. Detector 54, by way of non-limiting example, may be a heat detector or, alternatively, a smoke detector.

Referring to FIGS. 2-12, details of trim manifold assembly 22 are shown. Trim manifold assembly 22 may include a solid one-piece manifold 60 with a plurality of fluid passages therein to allow trim manifold assembly 22 to control the operation of valve 24, as described below. Manifold 60 may be metal and the passages therein may be formed by machining the passages into a solid manifold block.

Figure 6:
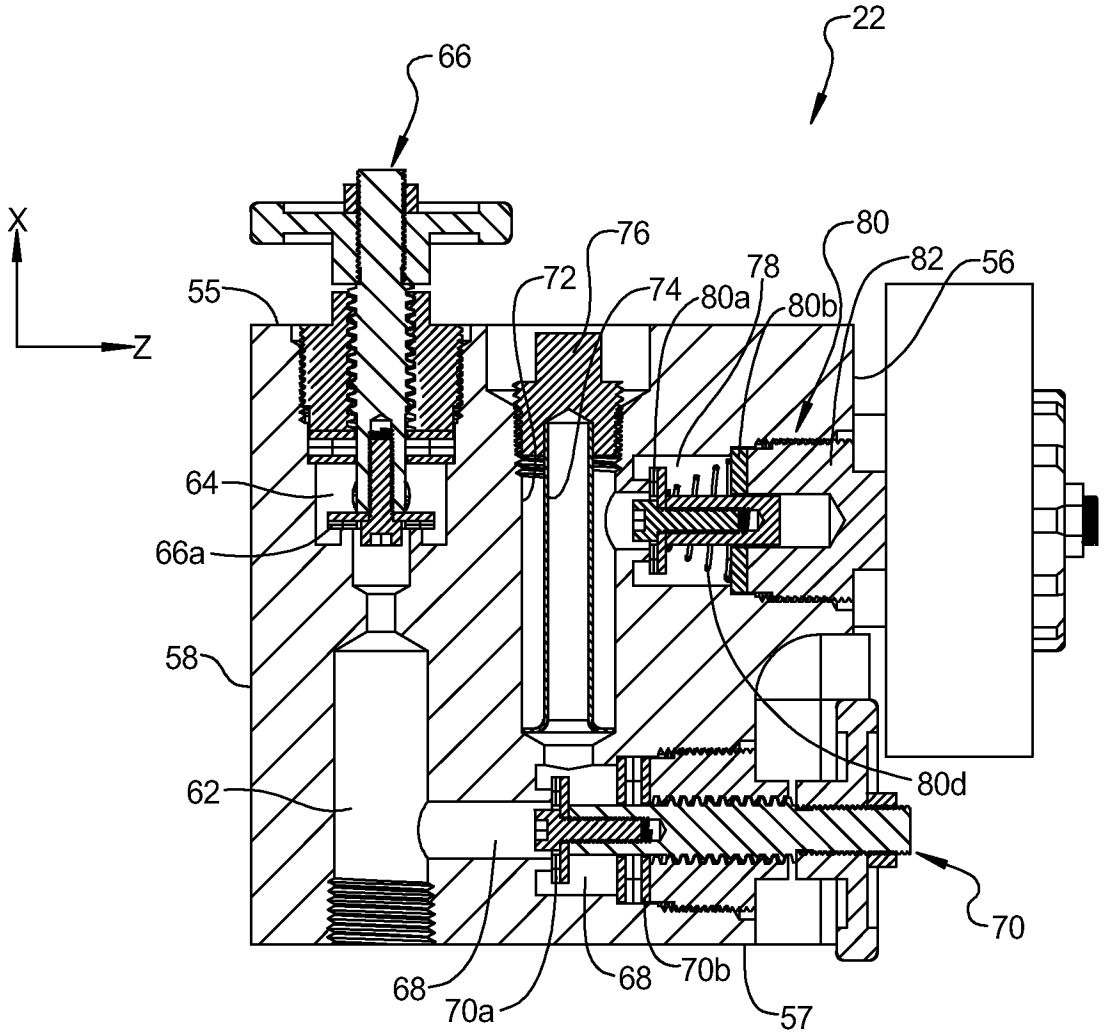
FIGS. 6-8 are cross-sectional views along lines 6-6, 7-7, and 8-8, respectively, of FIG. 5.
Figure 12:
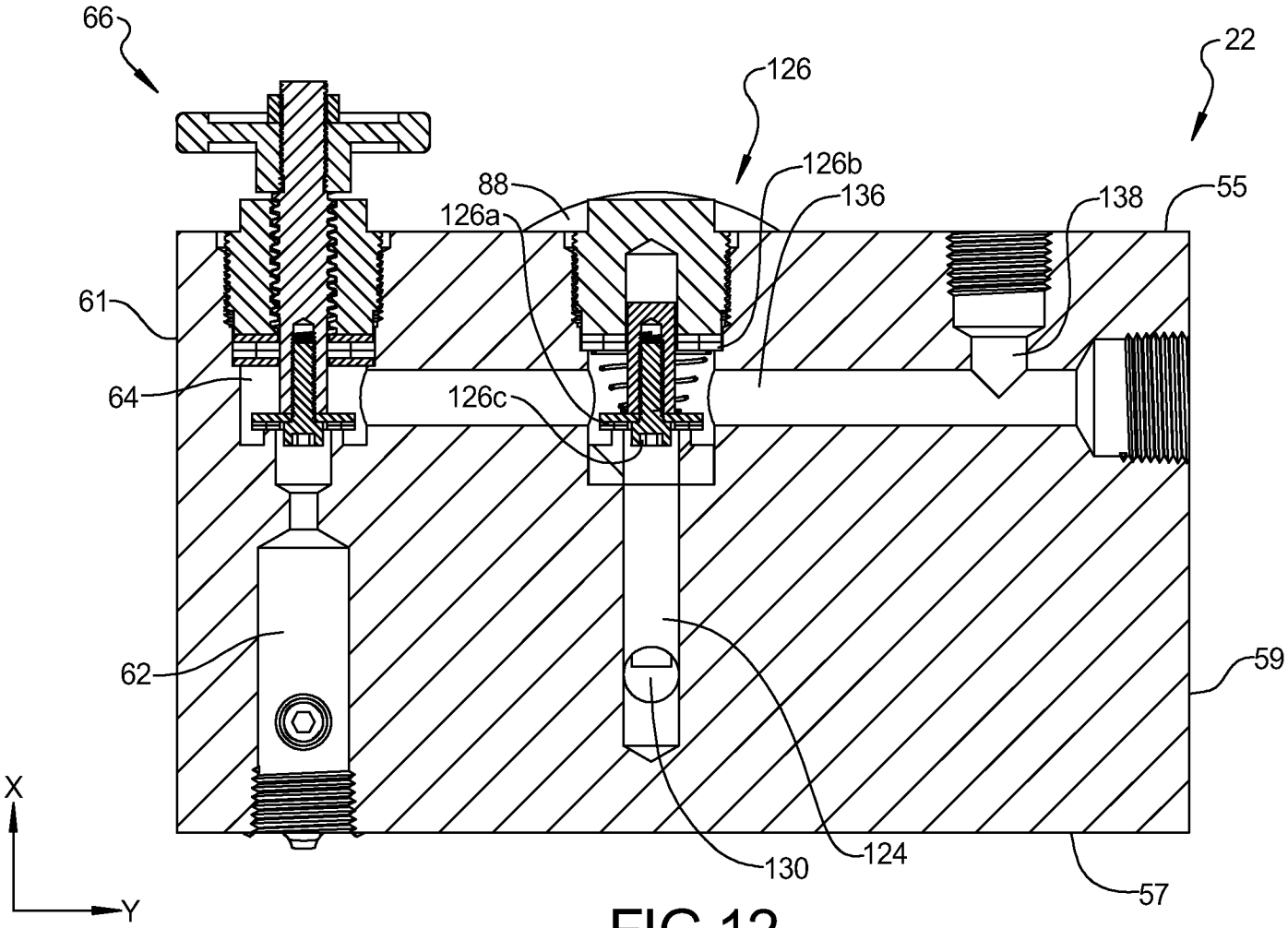
Figure 13:
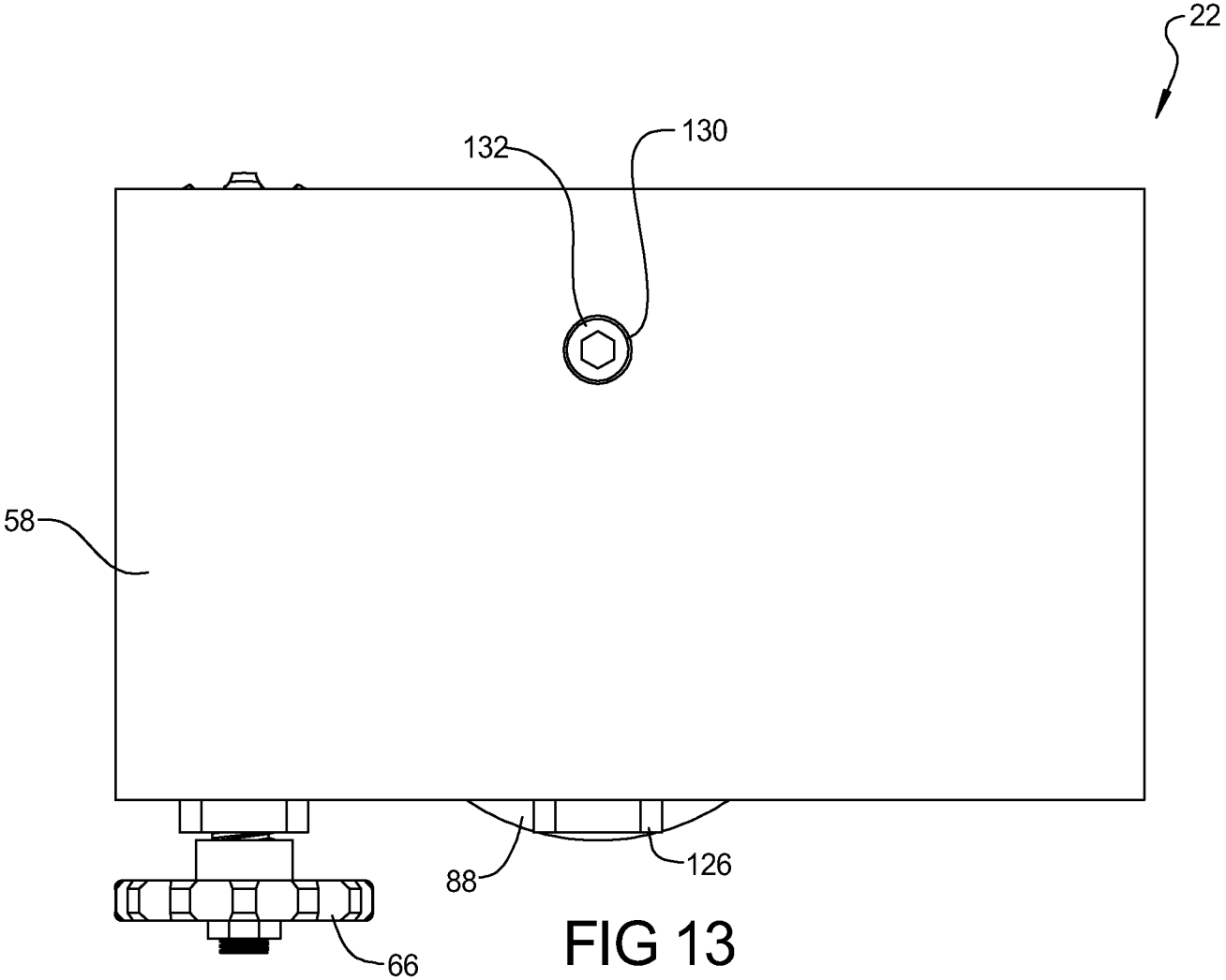
FIG. 13 is a back plan view of the trim manifold assembly of FIG. 1.
Figure 14:
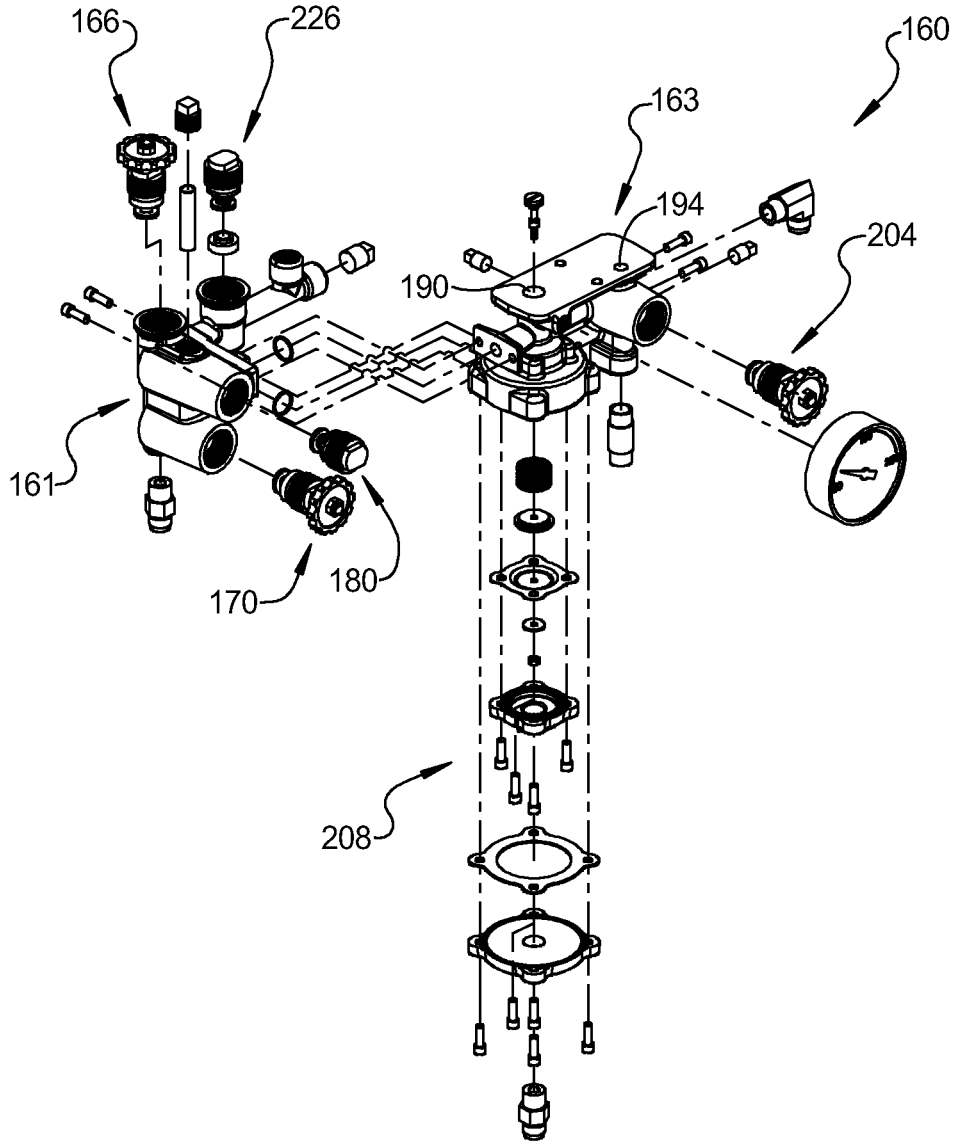
FIG. 14 is an exploded perspective view of an alternate trim manifold assembly according to the present disclosure.

Manifold 60 may have a top surface 55, a front surface 56, a bottom surface 57, a back surface 58, a right side surface 59, and a left side surface 61. Manifold 60 includes a prime input passage 62 that extends from bottom surface 57 into manifold 60 along the X axis. An alarm test valve passage 64 also extends along the X axis into manifold 60 from top surface 55 and is aligned with and connected to prime input passage 62, as seen in FIGS. 6 and 12. Conduit 50 is connected to prime input passage 62 while an alarm test valve assembly 66, which is normally closed, is located in alarm test valve passage 64. A prime-line shut-off valve passage 68 extends along the Z axis within manifold 60 from front surface 56 and intersects prime input passage 62, as shown in FIG. 6. A prime-line shut-off valve assembly 70, which is normally open, is disposed in passage 68. A prime-line strainer passage 72, as shown in FIG. 6, extends along the X axis from top surface 55 into manifold 60 and intersects passage 68 between seat seal 70*a* and stem seal 70*b* of prime-line shut-off valve assembly 70. A strainer 74 is disposed in passage 72 and retained with a plug 76. A prime-line check valve passage 78 extends along the Z axis from front surface 56 into manifold 60 and intersects passage 72. A check valve assembly 80 is disposed in check valve passage 78 and retained by a plug 82.

Figure 7:
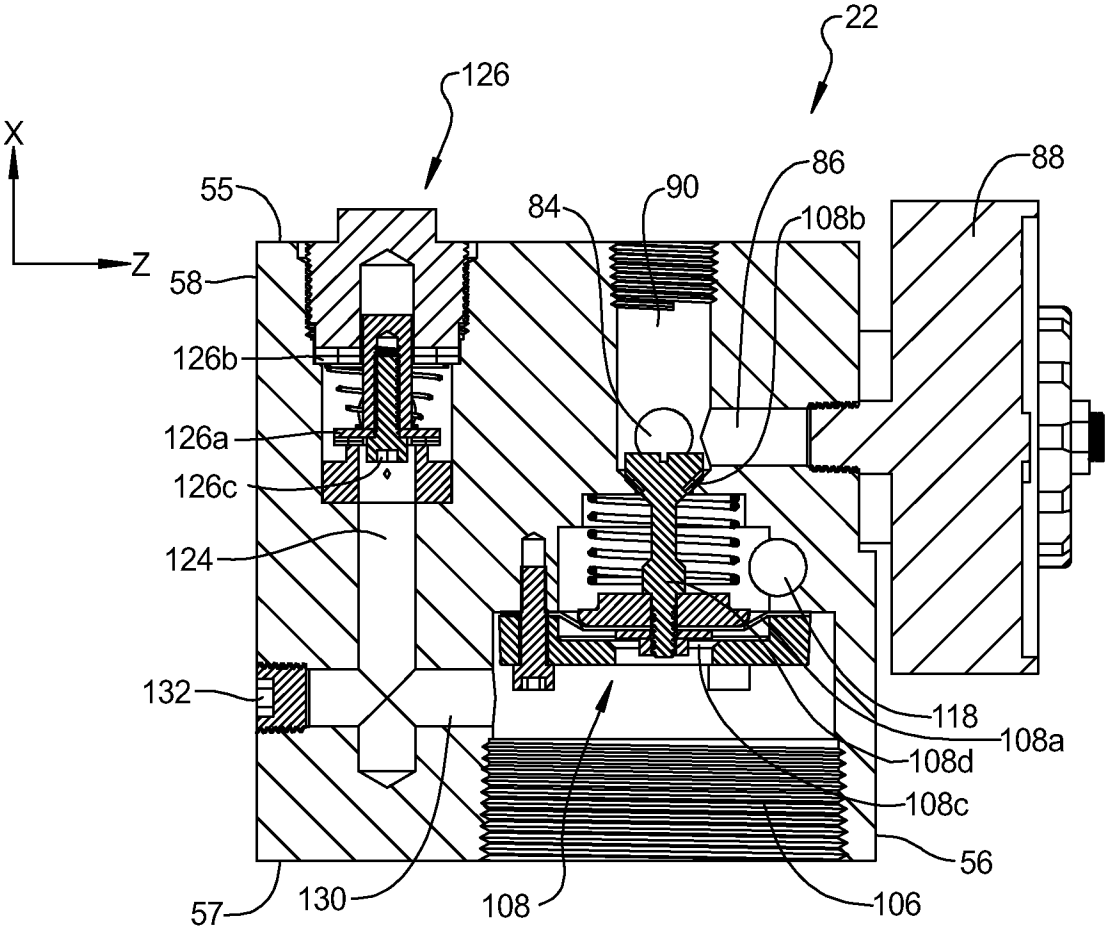
Figure 11:
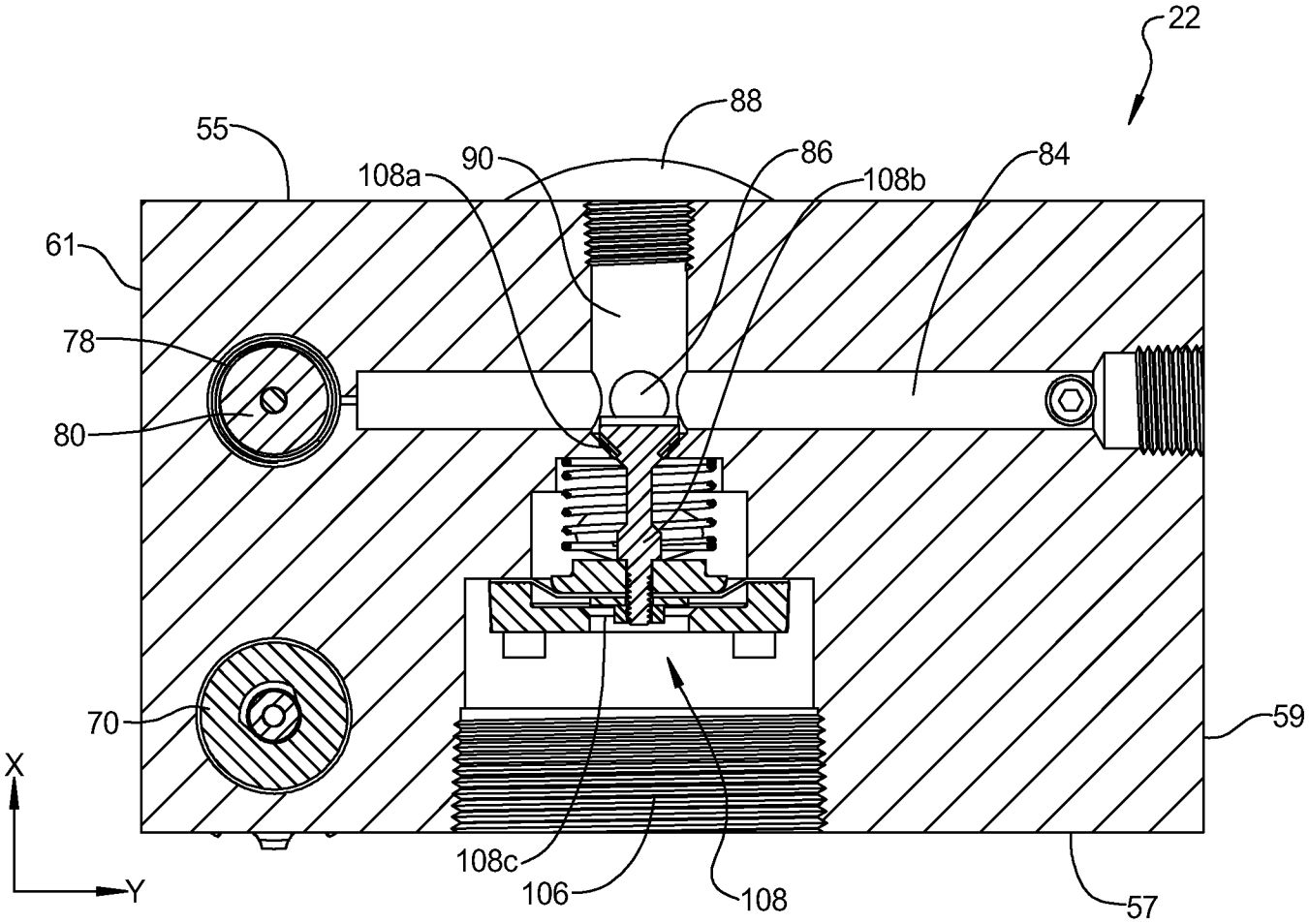

A prime-line output passage 84 extends along the Y axis from right side surface 59 into manifold 60 and intersects prime-line check valve passage 78, as shown in FIG. 11. Conduit 48 is attached to prime-line output passage 84 on right side surface 59 of manifold 60. A gage passage 86 extends along the Z axis from front surface 56 into manifold 60 and intersects passage 84, as shown in FIG. 7. A pressure gage 88 is disposed in gage passage 86 and indicates the fluid pressure in passage 84. A release passage 90 extends along the X axis from top surface 55 into manifold 60 and intersects prime-line output passage 84, as shown in FIGS. 7 and 11. Release mechanism 30 is coupled to release passage 90 by conduit 92, as shown in FIG. 1.

Figure 8:
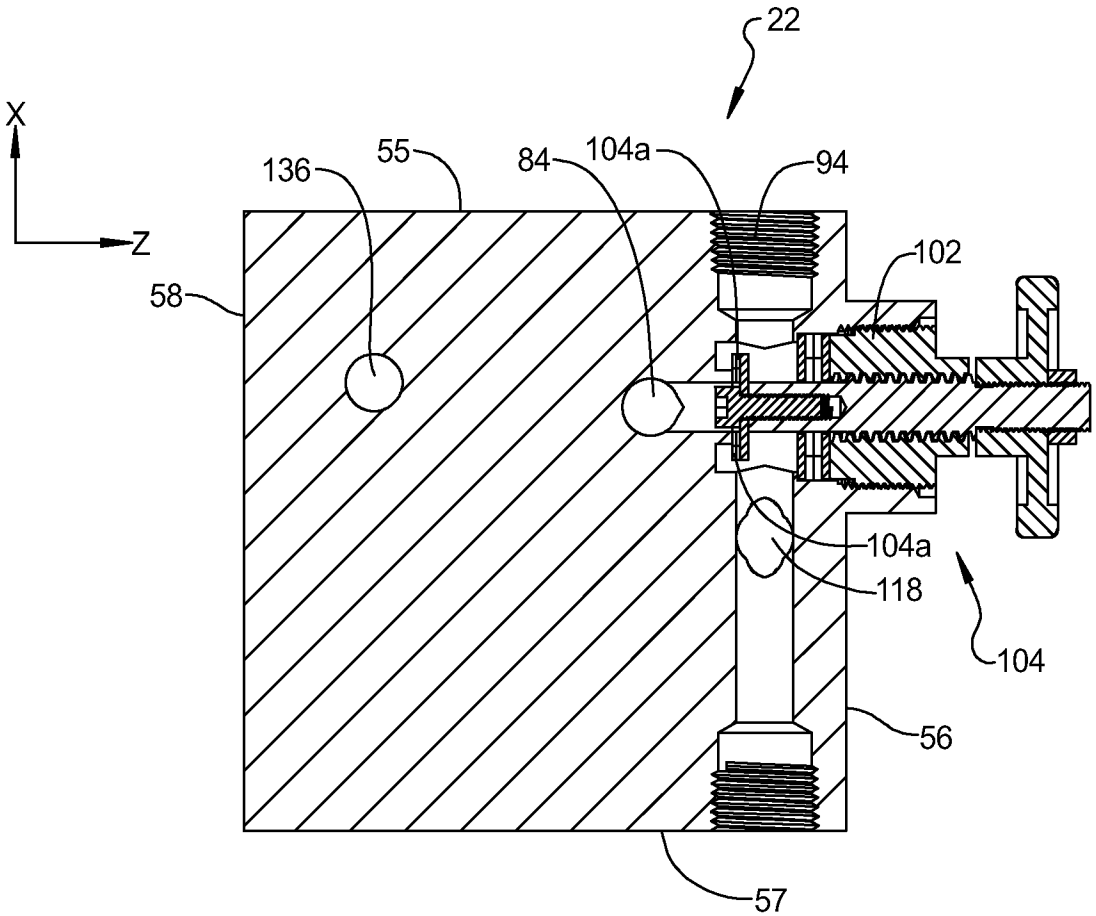
Figure 9:
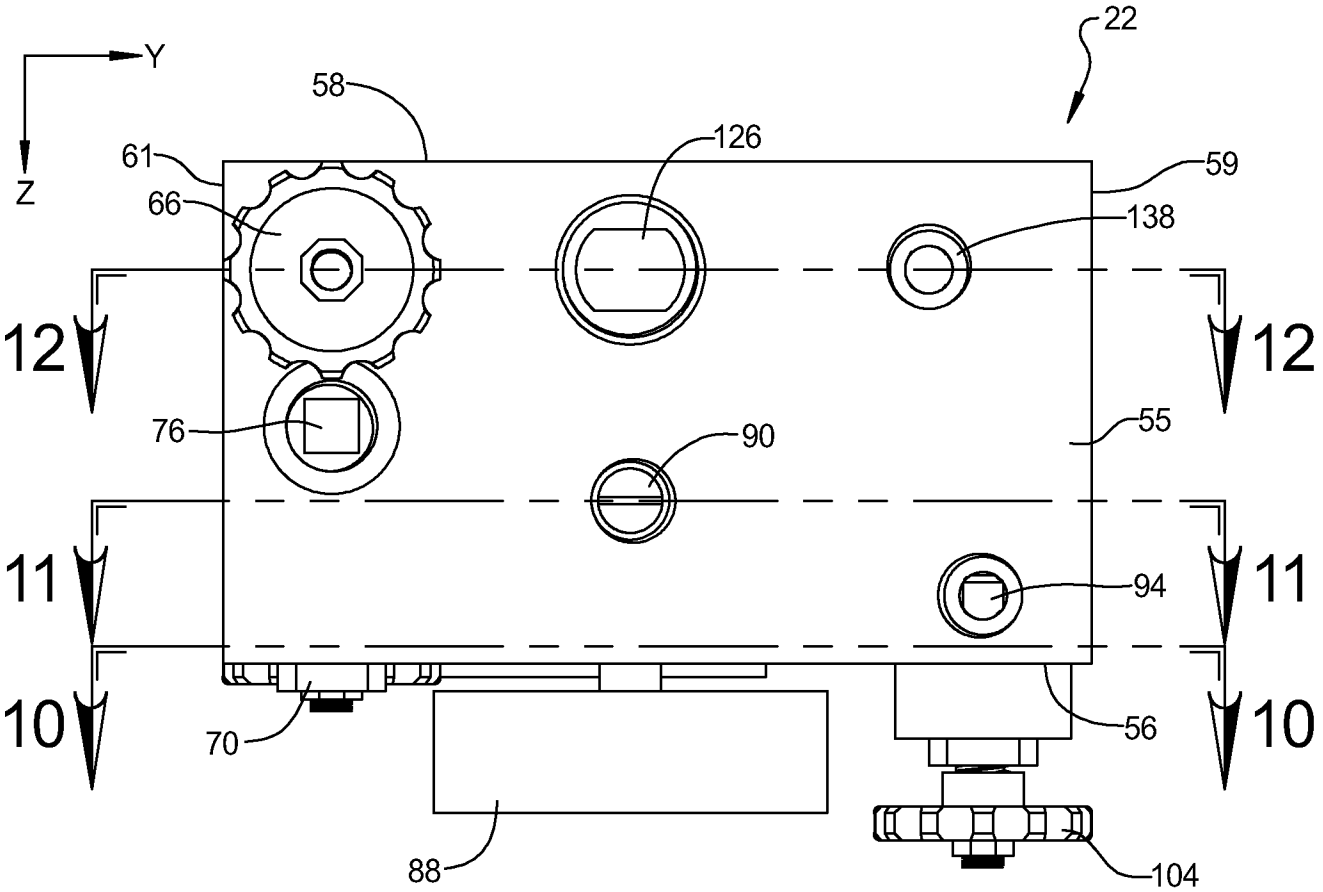
FIG. 9 is a top plan view of the trim manifold assembly of FIG. 1.
Figure 10:
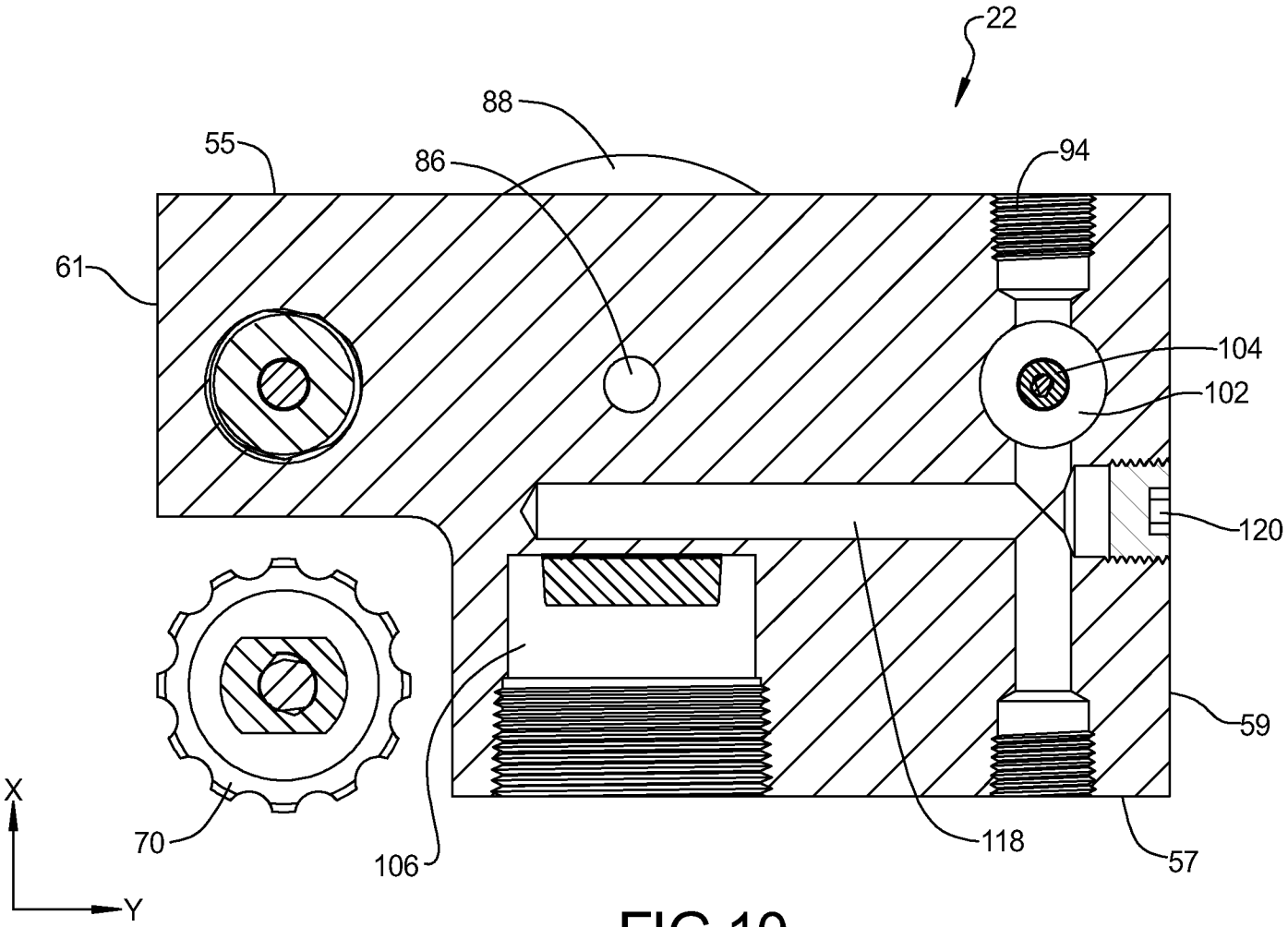
FIGS. 10-12 are cross-sectional views along lines 10-10, 11-11, and 12-12, respectively, of FIG. 9.

A drain passage 94 extends along the X axis from top surface 55 through manifold 60 and out bottom surface 57, as shown in FIGS. 8 and 10. A conduit 96 extends from release mechanism 30 to drain passage 94 on top surface 55, as shown in FIG. 1. Conduits 92, 96 and release mechanism 30 may collectively be referred to as a release line assembly 97. A conduit 98 extends from drain passage 94 at bottom surface 57 of manifold 60 to an open drain 100, also as shown in FIG. 1. Conduit 98 may be a flex hose. An emergency relief passage 102 extends along the Z axis from front surface 56 into manifold 60 and intersects passageways 94 and 84, as shown in FIG. 8. An emergency relief valve assembly 104, which is normally closed, is disposed in passage 102.

A pressure operating relief valve (PORV) passage 106 extends along the X axis from bottom surface 57 into manifold 60 and intersects release passage 90, as shown in FIGS. 7 and 11. PORV passage 106 and release passage 90 may be coaxial. A pressure operated relief valve (PORV) 108, which is normally closed, is disposed in PORV passage 106. A conduit 110 extends from PORV passage 106 at bottom surface 57 of manifold 60 to another conduit 112 which is in fluid communication with an intermediate chamber 114 of valve 24, as shown in FIG. 1. Conduit 110 may be a flex hose. Conduit 112 also communicates with open drain 100 through a drip check valve 116.

A PORV drain passage 118 extends along the Y axis from right side surface 59 into manifold 60 and intersects both drain passage 94 and PORV passage 106, as shown in FIGS. 7, 8, and 10. A plug 120 is disposed in the end of PORV drain passage 118 adjacent right side surface 59. A drain check valve passage 124 extends along the X axis from top surface 55 into manifold 60, as shown in FIGS. 7 and 12. A drain check valve assembly 126 is disposed in drain check valve passage 124. A connecting passage 130 extends along the Z axis from back surface 58 into manifold 60 and interconnects drain check valve passage 124 with PORV passage 106 below PORV 108, as shown in FIGS. 7 and 12. A plug 132 is disposed in connecting passage 130 adjacent back surface 58.

A first alarm passage 136 extends along the Y axis from right side surface 59 into manifold 60 and intersects with drain check valve passage 124 and alarm test valve passage 64, as shown in FIGS. 8 and 12. A second alarm passage 138 extends along the X axis from top surface 55 into manifold 60 and intersects first alarm passage 136. First and second alarm passages 136, 138 may be connected to alarms for fire protection system 20. The alarms may be operable to detect a pressure within first and second alarm passages 136, 138 which may be indicative of operation of control valve 24 due to a fire condition.

Referring again to FIG. 1, fire protection system 20 may also include an auxiliary drain valve 142 which is coupled to conduit 112. Auxiliary drain valve 142 is normally closed and may be manually operated to drain fire suppressant from intermediate chamber 114 of valve 24. A flow test valve 144 may be coupled to the input 34 of valve 24. Flow test valve 144 is normally closed and may be opened to verify the flow of fire suppressant to valve 24.

Referring now to FIGS. 1-2, 6-8, and 10-12, operation of trim manifold assembly 22 and fire protection system 20 will be described. To place trim manifold assembly 22 in a ready or operational mode, the fire suppressant from fire suppressant supply 26 flows, via conduit 50, into prime input passage 62 and flows through the various passages that are in flow communication therewith the various valves in their normal operating position (i.e., either normally open or normally closed, as described above). This fire suppressant in trim manifold assembly 22 is also referred to as the priming fluid and is at a prime pressure and is in a closed volume within manifold 60 between the seat seal 66*a* of alarm test valve assembly 66, the stem seal 70*b* of prime-line shut-off valve assembly 70, plug 76 in prime-line strainer passage 72, stem seal 80*b* of check valve assembly 80, prime pressure gage 88, stem seal 108*b* of PORV 108, seat seal 104*a* of emergency relief valve assembly 104, release mechanism 30, and priming chamber 46 of valve 24 via conduit 48. Thus, when trim manifold assembly 22 is in the set or ready condition, fire suppressant (priming fluid) at the prime pressure (e.g., the pressure of fire suppressant supply 26) is disposed in a defined closed space within manifold 60, conduits 48, 50 and priming chamber 46 of valve 24. The pressure in priming chamber 46 controls the position of a clapper assembly 148, which opens and closes communication between input 34 and output 36 of valve 24.

Automatic operation of trim manifold assembly 22 is controlled by release mechanism 30. To release the pressure in priming chamber 46 and supply the fire suppressant to sprinkler system piping 28, release mechanism 30, which is normally closed, is activated to open a flow path into conduit 96. As stated above, release mechanism 30 may include one or more actuators, such as an electric, pneumatic, and/or hydraulic actuator, by way of non-limiting example, that can selectively allow flow communication between conduit 92 and conduit 96 and release the prime pressure in (depressurize) priming chamber 46. By way of non-limiting example, when release mechanism 30 includes an electrically actuated actuator, such as a solenoid valve, the actuator may be in communication with control panel 52 and is actuated to open when control panel 52 receives a signal from detector 54, which is actuated in a fire condition, or from sensor 44, which is indicative of a loss of the supervisory pressure in sprinkler system piping 28, such as when a sprinkler has opened.

A pneumatic actuator, by way of non-limiting example, can be included in release mechanism 30 and may be responsive to the pressure in sprinkler system piping 28. In particular, the pneumatic actuator is normally closed but is opened when the sensing side of the actuator detects a drop in pressure in sprinkler system piping 28. In a fire condition, when a sprinkler opens, the supervisory pressure in sprinkler system piping 28 is reduced, causing the pneumatic actuator to open.

In some embodiments, there may be multiple actuators in series arrangement that form release mechanism 30 and release line assembly 97. In these embodiments, multiple conditions may be required to occur in order to provide flow communication between conduits 92, 96 and release the prime pressure in priming chamber 46. In one dual actuator arrangement, when control panel 52 receives a signal from detector 54 of a fire condition and one or more sprinklers open in response to a fire condition, control panel 52 actuates the solenoid valve to open while the pressure drop in sprinkler system piping 28 opens the pneumatic actuator so that the pressure is released from priming chamber 46. The use of multiple actuators in release mechanism 30 can provide a double interlock system. It should be appreciated that release mechanism 30 can include a variety of different types of actuators and/or a combination of actuators to provide the desired interlocking and releasing of the pressure within priming chamber 46 for fire protection system 20.

When release mechanism 30 and the actuator therein are opened to allow flow communication between conduit 92 and conduit 96, the pressure of the fire suppressant in trim manifold assembly 22 is reduced as the fire suppressant can flow out of trim manifold assembly 22 through release passage 90. The fire suppressant flows from conduit 92 past the actuator of release mechanism 30 and into conduit 96 for travel back into trim manifold assembly 22 through drain passage 94. Within drain passage 94, the fire suppressant flows through trim manifold assembly 22 and exits therefrom through conduit 98 and into open drain 100, thereby being discharged. The reduction of the prime pressure causes the operation of valve 24. Specifically, the reduction in the pressure in priming chamber 46 allows clapper assembly 148 to move, thereby allowing flow communication between input 34 and output 36. As a result, fire suppressant can flow through sprinkler system piping 28.

As valve 24 is caused to operate, the fire suppressant at an intermediate pressure in intermediate chamber 114 enters PORV passage 106 of manifold 60 through conduit 110. The fire suppressant enters connecting passage 130 and drain check valve passage 124. The fire suppressant overcomes the biasing closed force and travels through drain check valve assembly 126 and enters first and second alarm passages 136, 138, wherein the sensors attached thereto can detect the pressure. The fire suppressant also enters a sensing port 108*c* of PORV 108. The pressure at sensing port 108*c* causes PORV stem 108*d* to move, thus breaking the PORV stem seal 108*b* and seat seal 108*a*. The effect of the operation of PORV 108 will prevent accumulation of fire suppressant and pressure buildup in release passage 90 in the case that the actuator of release mechanism 30 ceases to operate (i.e., closes). If the actuator of release mechanism 30 ceases to operate, the fire suppressant will drain (discharge) through release passage 90, past PORV stem seal 108*b*, through PORV drain passage 118, out of manifold 60 through drain passage 94, and into conduit 98 through open drain 100.

Thus, when the pressure in priming chamber 46 is released (depressurized), the flow of fire suppressant from fire suppressant supply 26 to sprinkler system piping 28 occurs and PORV 108 in conjunction with trim manifold assembly 22 prevents an increase in pressure in priming chamber 46 even in the event that release mechanism 30 were to reset and close flow communication between conduits 92 and 96.

In order to reset trim manifold assembly 22 to working condition, the pressure at PORV passage 106 must be removed so that PORV 108 can return to its normally closed state. The pressure in PORV passage 106 can be removed by closing supply control valve 32 and draining the fire suppressant liquid from the system.

Trim manifold assembly 22 may be manually operated as opposed to automatic actuation, discussed above. The manual operation varies from the automatic operation only in the terms of the initiation of the operation. In the manual operation, the operator opens emergency relief valve assembly 104, which reduces the fire suppressant pressure from prime input passage 62 and prime-line output passage 84. In particular, the opening of emergency relief valve assembly 104 allows the fire suppressant to be discharged through drain passage 94 to open drain 100 via conduit 98, thereby relieving the pressure. This begins the remaining operation of trim manifold assembly 22, as described above. Accordingly, further description of the operation of trim manifold assembly 22, when manually operated, is not discussed further.

Trim manifold assembly 22 allows for the pressure alarms coupled to first and second alarm passages 136, 138 to be tested without activating valve 24. Alarm test valve assembly 66 can be opened, which results in fire suppressant in prime input passage 62 flowing past seat seal 66*a* and into alarm test valve passage 64. The fire suppressant will then enter drain check valve assembly 126 between seat seal 126*a* and stem seal 126*b*. This traps the pressure in this chamber and thus prevents the operation of PORV 108. The fire suppressant travels through drain check valve assembly 126 to first and second alarm passages 136, 138. The alarm sensors coupled to first and second alarm passages 136, 138 can detect the pressure in those passages. When the alarm pressure is verified, alarm test valve assembly 66 can be closed. The fire suppressant that is in first and second alarm passages 136, 138 and in drain check valve assembly 126 will then drain through an orifice 126*c* in drain check valve assembly 126, through drain check valve passage 124, connecting passage 130 and PORV passage 106, as shown in FIGS. 7 and 12. The fire suppressant will continue to drain through conduit 110 and through drip check valve 116 into open drain 100, as shown in FIG. 1. Thus, trim manifold assembly 22 allows for the pressure alarms to be tested without activating valve 24 and PORV 108.

Check valve assembly 80 in prime-line check valve passage 78 can protect the prime pressure in priming chamber 46 of valve 24 from being reduced as a result of varying supply pressures of the fire suppressant and/or operation of alarm test valve assembly 66. In particular, as fire protection system 20 is being put into an operating condition, prime-line check valve assembly 80 lets the fire suppressant go past seat seal 80*a* as the pressure overcomes the force of the biasing spring 80*d*. Once the prime pressure in prime-line check valve assembly 80 reaches its set pressure, spring 80*d* causes seat seal 80*a* to close and, as a result, retain the pressure in prime-line check valve passage 78. By retaining the pressure in prime-line check valve passage 78, prime-line check valve assembly 80 protects the pressure in priming chamber 46 of valve 24 from being subjected to varying pressures as a result of potentially varying supply pressure of the fire suppressant. Additionally, this also protects priming chamber 46 from being subjected to varying pressures as a result of operation of alarm test valve assembly 66.

Drain check valve assembly 126 is configured to allow the pressure in first and second alarm passages 136, 138 to be drained through PORV passage 106 while not causing the operation of PORV 108. In particular, when alarm test valve assembly 66 is opened, fire suppressant from prime input passage 62 flows through manifold 60 to the port between seat seal 126*a* and stem seal 126*b*. The fire suppressant pressure is checked from PORV sensing port 108*c* by drain check valve assembly 126 which is a drip check valve. Drain port (orifice) 126*c* of drain check valve assembly 126 is sized such that it is sufficient to drain the pressure from first and second alarm passages 136, 138 through PORV passage 106 while not causing the operation of PORV 108. Drain check valve assembly 126 allows the fire suppressant to flow into first and second alarm passages 136, 138 at a first flow rate while also allowing fire suppressant to flow out of first and second alarm passages 136, 138 through drain port 126*c* at a second flow rate substantially less than the first flow rate. This prevents operation of PORV 108 and thus operation of fire protection system 20 when testing the pressure alarms.

It should be appreciated that drip check valve 116 works in conjunction with trim manifold assembly 22 to facilitate the reducing of pressure from first and second alarm passages 136, 138 and allow the testing of the pressure sensors coupled thereto. Furthermore, valve 24 includes an intermediate chamber 114 that is pressurized only upon activation of valve 24 through trim manifold assembly 22 and the release of the pressure from priming chamber 46. Additionally, supply control valve 32 may be closed to allow trim manifold assembly 22 and fire protection system 20 to be setup and also to shutdown the operation of trim manifold assembly 22 and fire protection system 20. Auxiliary drain valve 142, while having no interdependence on trim manifold assembly 22, can be utilized to restore fire protection system 20 and trim manifold assembly 22 to its original operating condition by relieving pressure from PORV passage 106 and intermediate chamber 114.

Trim manifold assembly 22 according to the present invention can be used with other types of control valves 24. For example, trim manifold assembly 22 can be used with a control valve that utilizes a different type of fluid pressure activated device, such as a side differential valve instead of the priming chamber. In such an application, a side differential valve is operable to maintain the clapper (or other flow communication device within control valve 24) in a closed position, thereby preventing flow of fire suppressant from fire suppressant supply 26 to sprinkler system piping 28. The side differential valve may communicate with the trim manifold assembly 22 such that when a fire condition is detected, trim manifold assembly 22 can utilize release line assembly 97 to release pressure (depressurize the priming fluid) in the side differential valve. Releasing the pressure in the side differential valve can thereby activate the control valve, allowing flow communication between input 38 and output 36, and allowing fire suppressant fluid to flow to sprinkler system piping 28 from fire suppressant supply 26 by activation of release mechanism 30. As a result, fire suppressant can flow through sprinkler system piping 28. The activation of the control valve can cause fire suppressant at an intermediate pressure from an intermediate pressure chamber 114 to enter PORV passage 106 and manifold 60 through conduit 110. This intermediate pressure fluid can enter into first and second alarm passages 136, 138, wherein the sensors attached thereto can detect the pressure, as described above. Furthermore, the fire suppressant at the intermediate pressure can also be present at pressure sensing port 108*c* causing PORV stem 108*d* to move, thus breaking the PORV stem seal 108*b* and seat seal 108*a*, as discussed above. Thus, when the pressure in the side differential valve is released (de-pressurized), the flow of fire suppressant from fire suppressant supply 26 to sprinkler system piping 28 occurs and PORV 108 in conjunction with trim manifold assembly 22 prevents an increase in pressure in the side differential valve, even in the event that release mechanism 30 were to reset and close flow communication between conduits 92 and 96.

The use of a side differential valve may allow for different pressure differentials to be utilized that may allow for smaller sizes of the component devices for a given flow rate and/or quicker reaction. For example, the side differential valve may have a differential of 4.5 to 1 as compared to a differential of a control valve having a priming chamber which may be 1.1 to 1, by way of non-limiting example.

A trim manifold assembly according to the present invention may also be utilized in other types of fire protection systems, such as dry systems, wet valve systems, and deluge systems. The specific flow passages in communication within trim manifold assembly 22 can vary depending upon the needs to activate the control valve associated with these different fire protection systems. It should be appreciated that in these varying applications, the configuration of the release line assembly 97 can vary depending upon the needs of the system.

In some embodiments, release line assembly 97 may be in the form of another manifold assembly that can be coupled to trim manifold assembly 22. In this manner, trim manifold assembly 22 may be utilized for a variety of different applications while the release line assembly manifold configured for a specific application can be utilized with trim manifold assembly 22 to meet the needs of the fire protection system. For example, when the release line assembly is provided as an integral manifold, one or more release mechanisms 30 can be incorporated therein to provide the desired functionality, such as a single interlocked, a double interlocked and the like, as discussed above, by way of non-limiting example. The release line assembly manifolds can all be configured to be coupled to release passage 90 and drain passage 94. In this manner, the trim manifold assembly 22 may be a universal trim manifold assembly, while a specific release line assembly manifold is utilized to meet the particular design requirements for the fire protection system. Use of a release line assembly manifold in conjunction with trim manifold assembly 22 can facilitate the interconnection thereof, while diminishing the possibility of inadvertent connections or incorrect installation. Moreover, by utilizing a universal trim manifold assembly 22, less parts may be required to be stocked by suppliers of the components as trim manifold assembly 22 can be utilized with a variety of different fire protection systems and the release line assembly manifold chosen for the particular application.

While the present invention has been described with reference to specific embodiments, illustrations, and descriptions of same, it should be appreciated that the foregoing is not intended to be exhaustive or to limit the invention. The various features and/or configurations can be altered from that shown while still providing the described functionality. For example, the passageways, while being described as extending along either the X, Y, or Z axis, can extend in other orientations different than those shown and described. Additionally, the various valve assemblies may come in different configurations that provide the described functionality and various flow communications between the various passages depending upon differing operating conditions.

Moreover, while the trim manifold assembly 22 is shown and described as being a single solid member with the flow paths formed from one or more straight passages machined therein, it should be appreciated that the trim manifold assembly 22 may be formed from a variety of pieces that are assembled together to have the desired flow paths therethrough. Additionally, the flow paths may be configured in orientations other than straight. By way of non-limiting example, one or more components of the trim manifold assembly may be molded or cast and the associated passages therein cast or molded into the associated member. As such, the passages may take on configurations other than being straight, such as being curved. Furthermore, it should be appreciated that while the present invention has been described as reference to specific embodiments, illustrations, and descriptions of same, other features and components that may be present and utilized, such as strainers, restricted prime orifice, serviceable strainer, or gauge, by way of non-limiting example. As such, the trim manifold assembly may include other features and components, such as those mentioned.

In another arrangement, shown in FIGS. 14-18, a multi-piece fire protection system manifold assembly 160 may be used in the fire protection system 20 illustrated in FIG. 1 in place of the manifold 60. The protection system manifold assembly 160 may be similar to the manifold 60 shown in FIGS. 1-13, but includes a separate alarm block 161 and release block 163 instead of being formed from a single solid block. The alarm block 161 forms a first monolithic body and the release block 163 forms a second monolithic body. The views shown in FIGS. 14-18 are generally similar to FIGS. 2 and 5-8, respectively. Similar elements include similar reference numerals increased by "100". For simplicity, similar elements will not be described in detail with the understanding that the description and operation from FIGS. 1-13 applies.

Figure 15:
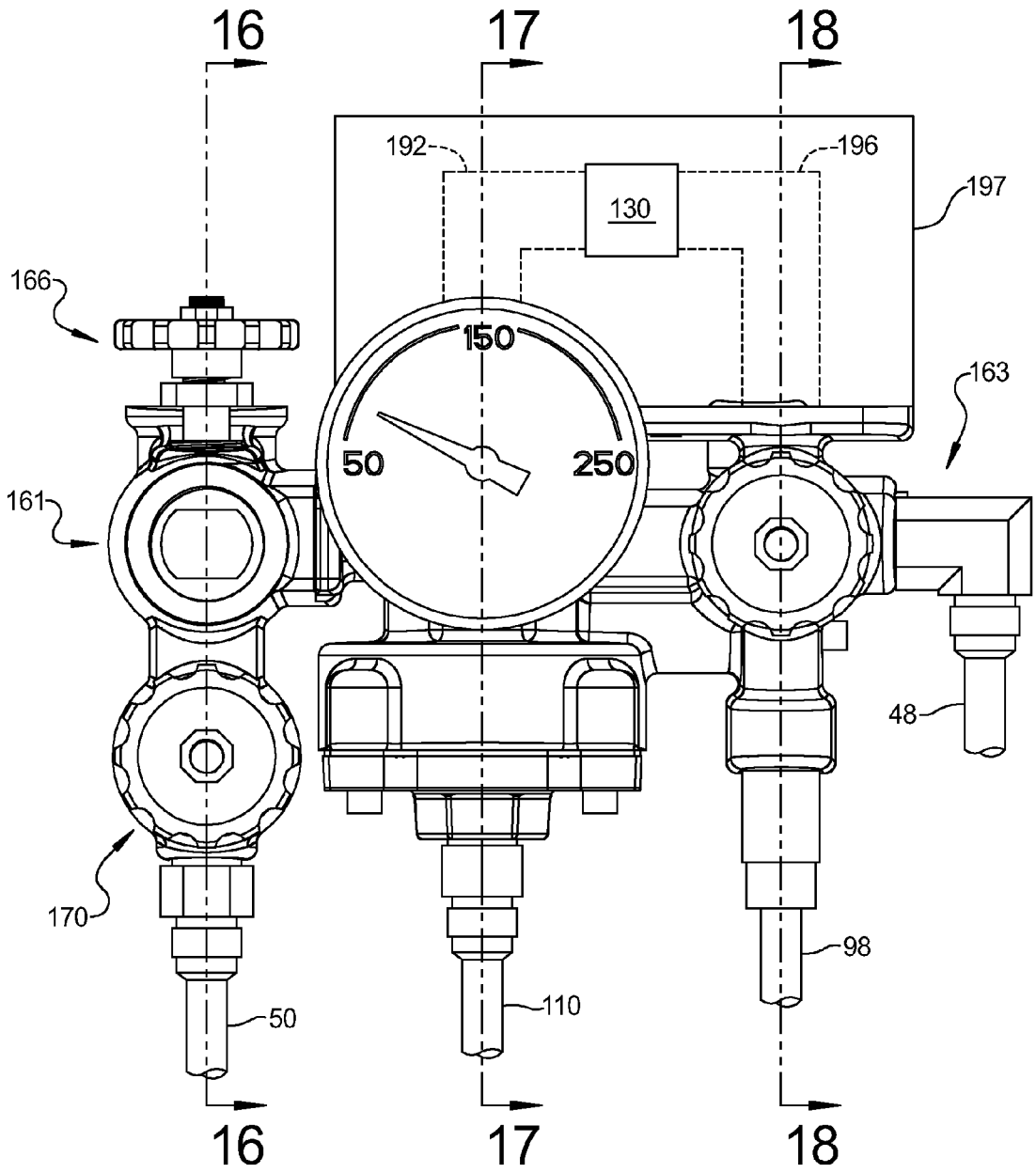
FIG. 15 is a front plan view of the trim manifold assembly of FIG. 14.
Figure 16:
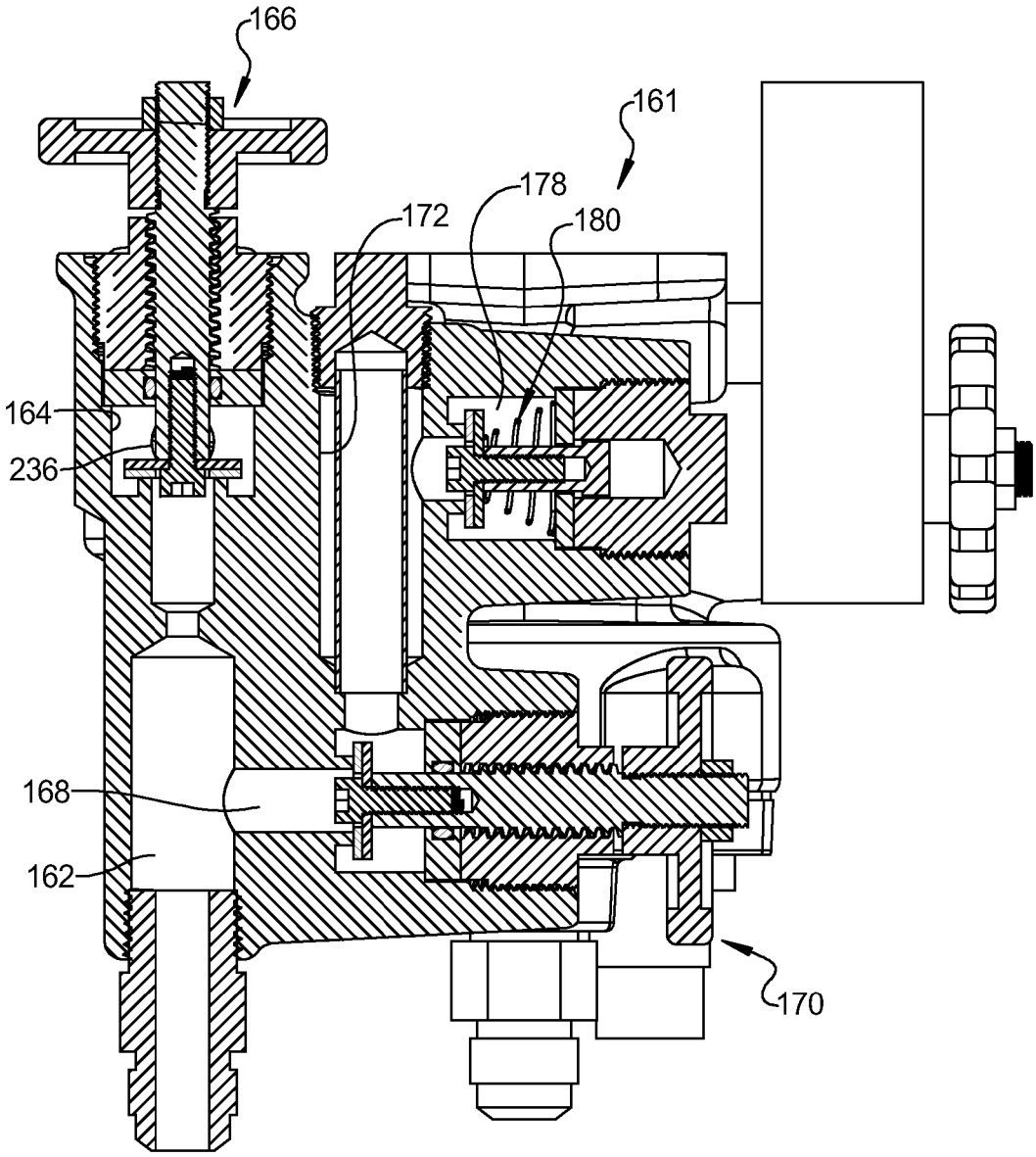
FIG. 16 is a cross-sectional view of the trim manifold assembly of FIG. 15 taken along line 16-16.
Figure 17:
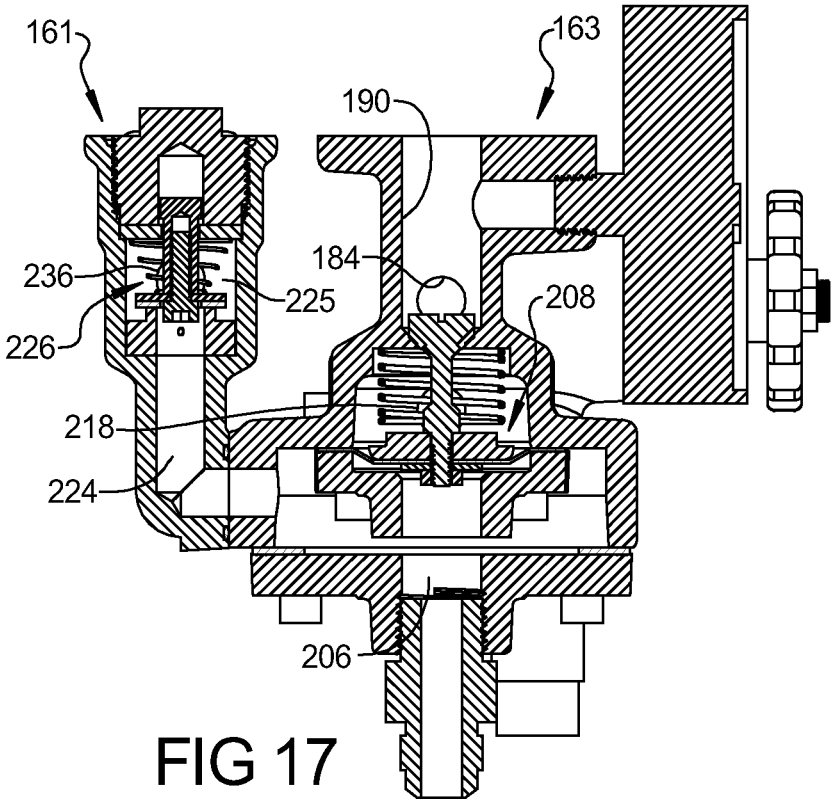
FIG. 17 is a cross-sectional view of the trim manifold assembly of FIG. 15 taken along line 17-17.

As seen in FIGS. 16 and 17, the alarm block 161 defines a prime line input passage 162, an alarm test passage 164, a first alarm passage 236 in communication with the alarm test passage 164, a prime line shut-off passage 168, a prime line strainer passage 172, a prime line check valve passage 178 (as seen in FIG. 16), a drain check valve housing 225, and a drain check valve passage 224 (as seen in FIG. 17). The first alarm passage 236 may house an alarm sensor (not shown). An alarm test valve assembly 166 is located in the alarm test passage 164, as seen in FIG. 16. A prime line shutoff valve assembly 170 is located in the prime line shut-off passage 168. A check valve assembly 180 is located in prime line check valve passage 178. With reference to FIG. 17, a drain check valve assembly 226 is located in the drain check valve housing 225. The alarm block 161 may be in communication with fire suppressant supply 26 through conduits 50 being in communication with prime line input passage 162, as shown in FIGS. 15 and 16.

Figure 18:
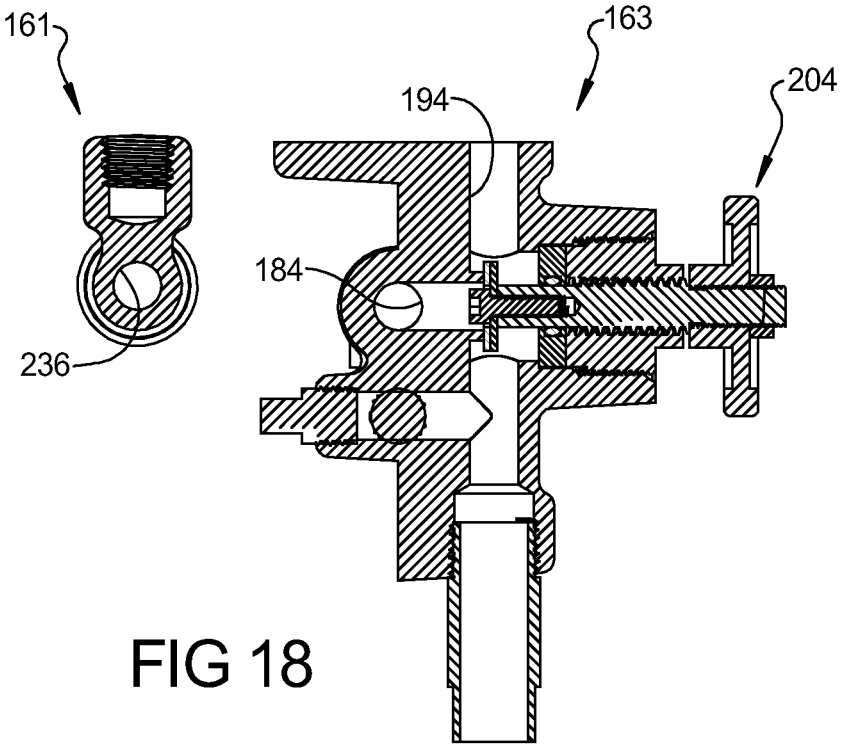
FIG. 18 is a cross-sectional view of the trim manifold assembly of FIG. 15 taken along line 18-18.

As seen in FIGS. 17 and 18, the release block 163 includes a prime line output passage 184, a release passage 190, a drain passage 194, a PORV passage 206, and a PORV drain passage 218. An emergency relief valve assembly 204 is located in drain passage 194. PORV 208 is located in the PORV drain passage 218.

The check valve assembly 180 forms a pressure control valve located in the alarm block 161 between the prime line input passage 162 and a first control passage defined by the prime line output passage 184. The check valve assembly 180 maintains a fixed volume of fire suppressant fluid at a prime pressure between check valve assembly 180 and the pressure-actuated system control valve 24 when in a closed position.

The drip check valve assembly 226 forms a pressure-actuated alarm valve and is normally biased into a closed position isolating the first alarm passage 236 from communication with a second control passage defined by the PORV passage 206. The drip check valve assembly 226 is displaced to an open position by fire suppressant fluid from the control valve 24 when the control valve 24 is open, providing fire suppressant fluid to the first alarm passage 236.

The alarm test valve assembly 166 forms a manual control valve that isolates the first alarm passage 236 from the prime line input passage 162 when in a closed position. The alarm test valve assembly 166 is normally in the closed position. The alarm test valve assembly 166 is manually displaceable to the open position to provide communication between the prime line input passage 162 and the first alarm passage 236 to activate the alarm sensor.

The prime line shutoff valve assembly 170 forms an additional manual control valve. The prime line shutoff valve assembly 170 is normally in the open position, providing communication between the prime line input passage 162 and the prime line output passage 184. The prime line shutoff valve assembly 170 is manually displaceable to the closed position to isolate the prime line output passage 184 from the prime line input passage 162.

The PORV 208 isolates the prime line output passage 184 (first control passage) from the PORV passage 206 (second control passage) until the PORV passage 206 (second control passage) exceeds a predetermined pressure. The emergency relief valve assembly 204 forms a manual control valve that isolates the prime line output passage 184 (first control passage) from the drain passage 194 when in a closed position. The emergency relief valve assembly 204 is manually displaceable to the open position to provide communication between the prime line output passage 184 and the drain 100 via the drain passage 194.

In the arrangement of FIGS. 14-18, a release control block 197 (FIG. 15) is coupled to the release block 163 to selectively open the control valve 24. The release control block 197 may be used in place of release line assembly 97 and defines first and second passages 192, 196 separated by a release mechanism 130. The first protection system 20 incorporating the multi-piece fire protection system manifold assembly 160 may be actuated in a manner similar to that described above using the release mechanism 30, and therefore will not be described in detail with the understanding that the description provided above applies equally.

Accordingly, the foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A fire protection system manifold assembly comprising:

a monolithic alarm block in communication with a fire suppressant fluid supply and defining a first alarm passage in communication with an alarm sensor;

a monolithic release block coupled to said monolithic alarm block and including a drain passage and a first control passage in communication with the fire suppressant fluid supply and a pressure-actuated system control valve to control communication between the fire suppressant fluid supply and a sprinkler system; and a release control valve in communication with said drain passage and said first control passage and selectively providing communication between said drain passage and said first control passage to control communication between the fire suppressant fluid supply and the sprinkler system;

wherein said monolithic alarm block defines an input passage in communication with the fire suppressant fluid supply and said first control passage.

2. The fire protection system manifold assembly of claim 1, further comprising a pressure control valve located in said monolithic alarm block between said input passage and said first control passage that maintains a fixed volume of fire suppressant fluid at a prime pressure between said pressure control valve and the pressure-actuated system control valve when in a closed position.

3. The fire protection system manifold assembly of claim 1, wherein said monolithic release block defines a second control passage in communication with the pressure-actuated system control valve and said first alarm passage in said monolithic alarm block.

4. The fire protection system manifold assembly of claim 3, further comprising a pressure-actuated alarm valve located in said first alarm passage of said monolithic alarm block and normally biased into a closed position by a biasing member and isolating said first alarm passage from said second control passage when the pressure-actuated system control valve is in said closed position and being displaced to an open position by fire suppressant fluid from the pressure-actuated system control valve when the pressure-actuated system control valve is in said open position.

5. The fire protection system of claim 4, further comprising a relief valve located in said monolithic release block between said first and second control passages and isolating said first and second control passages from one another until said second control passage exceeds a predetermined pressure.

6. The fire protection system manifold assembly of claim 1, further comprising a manual control valve located in said monolithic alarm block and isolating said first alarm passage from said input passage when in a closed position and providing communication between said first alarm passage and said input passage when in an open position to activate the alarm sensor.

7. The fire protection system manifold assembly of claim 1, further comprising a manual control valve located in said monolithic alarm block and isolating said first control passage from said input passage when in a closed position and providing communication between said input passage and said first control passage when in an open position.

8. The fire protection system manifold assembly of claim 1, further comprising a manual control valve located in said monolithic release block and isolating said first control passage from said drain passage when in a closed position and providing communication between said first control passage and said drain passage when in an open position.

9. The fire protection system manifold assembly of claim 1, wherein said drain passage provides communication between said monolithic release block and a drain.

10. A fire protection system comprising:

a fire suppressant fluid supply;

a pressure-actuated system control valve in communication with said fire suppressant fluid supply and displaceable between opened and closed positions;

a sprinkler system in communication with said pressure-actuated system control valve; and a fire protection system manifold assembly comprising:

a monolithic alarm block in communication with said fire suppressant fluid supply and defining a first alarm passage housing an alarm test valve in communication with an alarm sensor; and a monolithic release block coupled to said monolithic alarm block and defining a drain passage and a first control passage in communication with said fire suppressant fluid supply and said pressure-actuated system control valve to control communication between said fire suppressant fluid supply and said sprinkler system; and a release control valve in communication with said drain passage and said first control passage and selectively providing communication between said drain passage and said first control passage to control communication between the fire suppressant fluid supply and the sprinkler system;

wherein said monolithic alarm block defines an input passage in communication with the fire suppressant fluid supply and said first control passage.

11. The fire protection system of claim 10, further comprising a pressure control valve located in said monolithic alarm block between said input passage and said first control passage, said pressure control valve maintaining a fixed volume of fire suppressant fluid at a prime pressure between said pressure control valve and said pressure-actuated system control valve when in a closed position.

12. The fire protection system of claim 10, wherein said monolithic release block defines a second control passage in communication with said pressure-actuated system control valve and said first alarm passage in said monolithic alarm block.

13. The fire protection system of claim 12, further comprising a pressure-actuated alarm valve located in said first alarm passage of said monolithic alarm block and normally biased into a closed position isolating said first alarm passage from said second control passage when said pressure-actuated system control valve is in said closed position and being displaced to an open position by fire suppressant fluid from said pressure-actuated system control valve when said pressure-actuated system control valve is in said open position.

14. The fire protection system of claim 13, further comprising a relief valve located in said monolithic release block between said first and second control passages and isolating said first and second control passages from one another until said second control passage exceeds a predetermined pressure.

15. The fire protection system of claim 10, further comprising a manual control valve located in said monolithic alarm block and isolating said first alarm passage from said input passage when in a closed position and providing communication between said first alarm passage and said input passage when in an open position to activate said alarm sensor.

16. The fire protection system of claim 10, further comprising a manual control valve located in said monolithic alarm block and isolating said first control passage from said input passage when in a closed position and providing communication between said input passage and said first control passage when in an open position.

17. The fire protection system of claim 10, further comprising a manual control valve located in said monolithic release block and isolating said first control passage from said drain passage when in a closed position and providing communication between said first control passage and said drain passage when in an open position.

18. The fire protection system of claim 10, wherein said drain passage is in communication with a drain.

* * * * *